US009376304B2

(12) United States Patent
Trulaske et al.

(10) Patent No.: US 9,376,304 B2
(45) Date of Patent: Jun. 28, 2016

(54) TILTER FOR HOLDING A CONTAINER IN A PROGRESSIVELY LESS TILTED ORIENTATION WHILE RECEIVING A BEVERAGE FROM A DISPENSING SYSTEM

(75) Inventors: James A. Trulaske, Town and Country, MO (US); Stephen M. Schmitt, Hazelwood, MO (US)

(73) Assignee: Anheuser-Busch, LLC, St. Louis, MO (US)

( * ) Notice: Subject to any disclaimer, the term of this patent is extended or adjusted under 35 U.S.C. 154(b) by 129 days.

(21) Appl. No.: 14/239,517

(22) PCT Filed: Aug. 20, 2012

(86) PCT No.: PCT/US2012/051586

§ 371 (c)(1),
(2), (4) Date: Feb. 18, 2014

(87) PCT Pub. No.: WO2013/028621

PCT Pub. Date: Feb. 28, 2013

(65) Prior Publication Data

US 2014/0182743 A1 Jul. 3, 2014

Related U.S. Application Data

(60) Provisional application No. 61/525,490, filed on Aug. 19, 2011.

(51) Int. Cl.

| | |
|---|---|
| ***B67C 3/26*** | (2006.01) |
| ***B67D 1/08*** | (2006.01) |
| ***B67D 1/12*** | (2006.01) |

(52) U.S. Cl.

CPC ..... *B67D 1/0894* (2013.01); *B67D 1/1272* (2013.01); *B67D 2210/00112* (2013.01)

(58) Field of Classification Search

CPC .... B67D 1/1272; B67D 1/124; B67D 1/1247; B67D 1/0894; B67C 2003/2671

USPC ..... 141/271–272, 192–198

See application file for complete search history.

(56) References Cited

U.S. PATENT DOCUMENTS 382,023 A * 5/1888 Bauer ..... B67D 1/0894 141/271
939,069 A * 11/1909 McLean ..... B67D 1/124 251/156

(Continued)

FOREIGN PATENT DOCUMENTS

GB 2336997 A 11/1999
GB 2355054 A 4/2001

(Continued)

OTHER PUBLICATIONS

European Search Report, EP Application No. 12826149.2 mailed Apr. 17, 2015 (8 pages).

*Primary Examiner* — Patrick M Buechner
*Assistant Examiner* — Randall Gruby
(74) *Attorney, Agent, or Firm* — Gardere Wynne Sewell LLP

(57) ABSTRACT

A tilter for holding a container in a tilted position for receiving a beverage being dispensed from a dispensing system such as a beer faucet, which holds the container, such as a cup or mug, in an initial highly tilted orientation for receiving the dispensed beverage, and which progressively reduces the degree of tilt as the container fills. The tilter can operate in cooperation with the lever or other actuator of a dispenser to automatically be tilted to the initial highly tilted orientation when the actuator is operated to initially dispense, and to automatically operate the actuator to stop the dispensing of the beverage when a final reduced degree of tilt is reached and present the filled container for removal from the tilter.

18 Claims, 16 Drawing Sheets

(56) References Cited

U.S. PATENT DOCUMENTS 1,393,300 A * 10/1921 McNutt ..... B67D 1/124 251/156
1,516,850 A * 11/1924 Fitl ..... B67D 1/124 251/156
2,066,169 A * 12/1936 Zwosta ..... B67D 1/124 138/37
2,757,846 A * 8/1956 Varrin ..... B67D 1/0894 141/271
3,094,154 A * 6/1963 Daniels ..... B67D 1/06 141/369
4,974,643 A * 12/1990 Bennett ..... B67D 1/124 141/1
5,086,817 A * 2/1992 Murphy ..... B67D 1/1272 141/266
5,335,705 A * 8/1994 Morishita ..... B67D 1/04 141/104
5,791,385 A * 8/1998 Stahlecker ..... B65B 3/22 141/130
6,003,542 A * 12/1999 Pizzacalla ..... B67D 1/1247 137/210
6,648,025 B2 * 11/2003 Smith ..... B67D 1/1272 141/173
7,748,417 B2 7/2010 Arcuri
2004/0129004 A1 * 7/2004 Anderson ..... F25D 31/008 62/66
2009/0229699 A1 * 9/2009 Arcuri ..... B67D 1/0894 141/1

FOREIGN PATENT DOCUMENTS

GB 2355707 A 5/2001
GB 2387835 A 10/2003
JP H09 132296 A 5/1997
WO WO-03033397 A1 4/2003
WO WO 2007076584 * 7/2007

* cited by examiner

TILTER FOR HOLDING A CONTAINER IN A PROGRESSIVELY LESS TILTED ORIENTATION WHILE RECEIVING A BEVERAGE FROM A DISPENSING SYSTEM

This application claims the benefit of U.S. Provisional Application No. 61/525,490, filed Aug. 19, 2011.

TECHNICAL FIELD

This invention relates generally to a tilter for holding a container in a particular position and orientation for receiving a beverage being dispensed from a dispensing system such as a beer faucet for dispensing draught beer, and, more particularly, which holds the container, such as a cup or mug, in an initial highly tilted orientation for receiving the dispensed beverage, and which progressively reduces the degree of tilt as the container fills. As additional features, the tilter can be configured to operate in cooperation with the lever or other actuator of a dispenser to automatically be tilted to the initial highly tilted orientation when the actuator is operated to initially dispense, and to automatically operate the actuator to stop the dispensing of the beverage when a final reduced degree of tilt is reached and present the filled container for removal from the tilter.

BACKGROUND ART

The disclosure of U.S. Provisional Application No. 61/525,490, filed Aug. 19, 2011, is hereby incorporated herein in its entirety by reference.

Beverage dispensing systems, particularly faucets for the pouring of draught beer or other naturally and/or artificially pressurized beverages, are well known. Typically, when a beverage is to be dispensed, whether into a cup, mug, pitcher, or other container, and particularly when dispensing a carbonated beverage such as a beer, to control foaming, tipping or tilting to a sufficient degree and position such that the beverage impinges a target which is a relatively near surface, e.g., a side surface of the container, is highly sought. It is also sought to reduce the tilt of the container as it fills until it is upright or nearly upright when full or nearly full. Both of these objectives are commonly met by skilled pourers such as trained or experienced bartenders, but one or both are commonly not met by unskilled persons.

At stadiums and other high volume beverage dispensing locations, it is sought to dispense as many beverages as possible in a short time, such as between innings, periods, intermissions, and the like. It is also desired to maintain as high a quality as possible, e.g., minimized foaming of beer. However, lack of skill among dispensing personnel, e.g., unskilled temporary employees of the sports or other venues, has been found to negatively affect the quality of the dispensing. As another problem, personnel may be required to prepare and/or dispense food, collect payment, etc., while or between dispensing the beverages.

What is sought therefore, is a manner of, and/or apparatus for, dispensing which overcomes the shortcoming, and achieves the objectives, set forth above.

SUMMARY OF THE INVENTION

What is disclosed is a tilter for holding a container in a particular position and orientation for receiving a beverage being dispensed from a dispensing system such as, but not limited to, a beer faucet for dispensing draught beer, and, more particularly, which holds the container, such as a cup or mug, in an initial highly tilted orientation for receiving the dispensed beverage, and which automatically progressively reduces the degree of tilt as the container fills.

As an additional feature, the tilter can be configured to automatically operate in cooperation with the lever or other actuator of a dispenser to automatically tilt to the initial highly tilted orientation when the actuator is operated to initially dispense, gradually move to a less tilted, more upright position, and automatically operate the actuator to stop the dispensing of the beverage when a desired upright position is reached.

As another feature, the tilter can be attached to or incorporated onto the dispensing apparatus in a manner to facilitate joint or cooperative operation of the tilter and dispensing apparatus. As a non-limiting example, the tilter can be mounted to the spout of a conventional American beer faucet in a manner such that operation of an actuator of the faucet for dispensing the beer, such as, but not limited to, a lever or other device or element in connection with the dispensing valve, etc., of the faucet, will cause the tilter to tilt a container for receiving the beer to a desired initial angle of tilt, and then, as the beer is dispensed into the container, the tilter will gradually reduce the angle of tilting of the container until it is upright, or near upright, and will automatically move the dispenser actuator to its closed position.

DETAILED DESCRIPTION OF THE INVENTION

Figure 1:
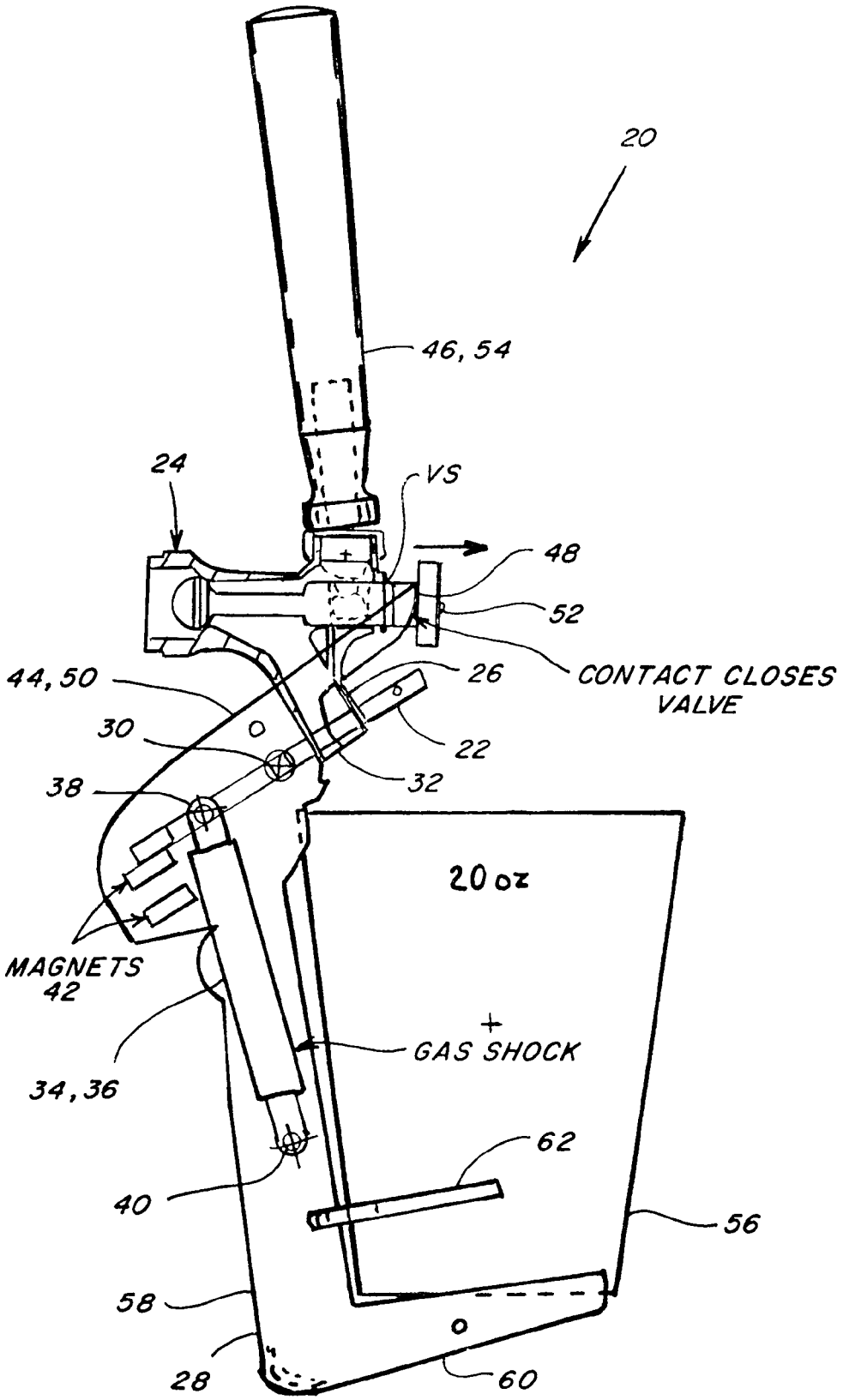
FIG. 1 is a side view of a beverage dispensing faucet including one embodiment of a tilter of the invention holding a container in an upright orientation under a spout of the faucet.
Figure 2:
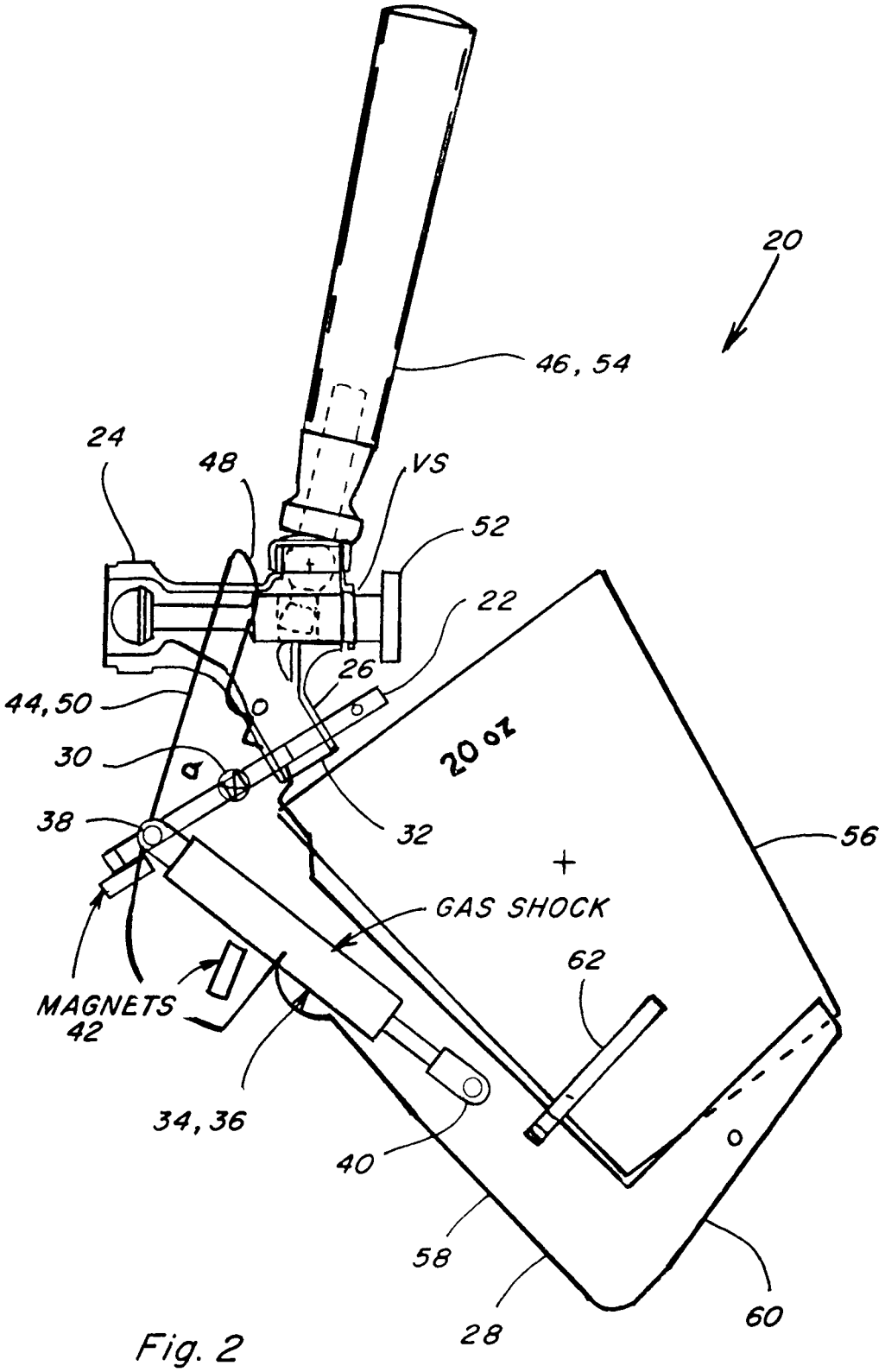
FIG. 2 is another side view of the faucet and tilter of FIG. 1, showing the tilter holding the container in a tilted position under the spout.

Referring to FIGS. 1 and 2, one embodiment of the tilter 20 of the invention includes a mounting bracket 22 for mounting tilter 20 on a dispensing apparatus which here is a conventional American beer faucet 24. Here also, bracket 22 is configured for mounting about a spout 26 of faucet 24. To accomplish this, bracket 22 is of a clamshell configuration, so as to be capable of clamping about spout 26 and being secured in position by a suitable fastener, such as a small screw, set screw, or the like. However, it should be understood that it is contemplated that the invention can be mounted in a wide variety of ways to adjacent structure or other element of a faucet.

Tilter 20 includes a container holding element28 connected to bracket 22 by a pivot joint 30 so as to be located beneath a discharge outlet 32 of spout 26 for receiving beer flowing therefrom. A yieldable biasing element 34 is connected between bracket 22 and container holding element 28 and is configured to yieldably urge container holding element 28 toward the tilted position of FIG. 2. In this regard, element 34 will be configured to yield to a force exerted thereagainst for moving container holding element 28 back toward the position of FIG. 1, which force will be exerted by the weight of the container supported thereby as the container fills with beer. Most preferably, element 34 will be configured to yield gradually in a manner corresponding to the gradual increase in weight of a container as it fills with the beverage, e.g. beer, to allow element 28 to gradually returned to the position of FIG. 1. As non-limiting example, biasing element 34 can comprise one or more automatically operable compressible fluid devices, such as a compressed gas strut or shock 36, of a suitable length, gas charge, and orifice size, to store sufficient energy when in its retracted state (FIG. 1) to provide this functionality. Here, one end of gas shock 36 is pivotally connected by a pivot joint 38 to mounting bracket 22, and the opposite end by a pivot joint 40 to container holding element 28. When in the position and configuration of FIG. 1, shock 36 will be in a retracted state, charged with its working fluid, in a manner so as store energy directed to urge container holding element 28 toward the highly tilted position of FIG. 2, and which will be released to actually pivot element 28 to that position. Advantageously, energy will be returned to shock 36 when element 28 is again moved to the position of FIG. 1.

Tilter 20 preferably includes a detent element 42 for releasably retaining or detaining container holding element 28 in the upright position of FIG. 1 with shock 36 in its retracted, charged condition. Here, detent element 42 is illustrated as comprising a pair of magnets on mounting bracket 22 and container holding element 28, oriented so as to be attracted to one another by their magnetic attraction force, for holding element 28 in the upright position. In this regard, shock 36 is advantageously oriented in its retracted state as shown in FIG. 1, relative to pivot joint 30 so as not to directly oppose and act against detent element 42. As a result, only a portion of the stored energy of shock 36 is directed in opposition to the detent element, enabling the detent element to hold the container holding element 28 in the position of FIG. 1, such that a triggering event will be required to release the detent element to enable shock 36 to release its energy to pivot element 28 to the position of FIG. 2.

To provide a triggering event, tilter 20 additionally preferably includes apparatus 44 for releasing detent element 42 and allowing shock 36 to effect the pivotal movement of container holding element 28 from its upright position (FIG. 1) to the initial tilted position (FIG. 2). Advantageously, tilter 20 is configured such that the triggering event will comprise movement of an actuator 46 of faucet 24 to open the faucet for dispensing beer. Here, this is implemented by configuring apparatus 44 as a lever mechanism having a contact surface 48 on the end of a lever arm 50 of container holding element 28 positioned when the element 28 is in the upstanding position of FIG. 1 to engage or be located proximate to a surface of a disk 52 located adjacent to an end of faucet 24. Disk 52 is attached internally to a dispensing valve stem VS of the faucet so as to be moved a short distance toward the faucet and forceably against contact surface 48 when the faucet is initially opened. This arrangement is advantageous as the force of this contact is used as the triggering event and provides the energy to initially release detent element 42 to enable shock 36 to pivot element 28 to the fully tilted position of FIG. 2. Disk 52 is then movable the short distance away from the faucet when closed. Here, actuator 46 includes a conventional upstanding dispensing lever 54 which is in the position of FIG. 1 for closing the faucet, and moved to the position of FIG. 2 for opening the faucet. As another advantage, it can be observed in FIG. 2 that when container holding element 28 is tilted, lever arm 50 is spaced from disk 52, to allow independent operation of the faucet. As an option, disk 52 can be configured to be sized and shaped, or include an appropriate handle, for grasping by a user for operating the faucet.

As another optional but desired feature, actuator 46 is configured such that the faucet can be closed by movement of disk 52 in the direction away from the faucet by contact with contact surface 48 when the tilter is returned to the position of FIG. 1. This is to allow a container filled to a desired level to automatically close the faucet to cease dispensing of the beer. Advantageously, as container holding element 28 is pivoting back to the position of FIG. 1 the attractive force of the magnets of detent element 42 can provide additional force for automatically closing the faucet. In this regard, the relative positions of the magnets can be selected or adjusted to vary the attractive force exerted against element 28, in FIG. 1 the magnets being shown slightly spaced apart, but providing sufficient attractive force for holding element 28 in the position shown until moved by the opening of the faucet.

Container holding element 28 can have any of a variety of configurations for holding any variety of containers, including, but not limited to, conventional or customized cups, mugs, pitchers, and the like. Here, element 28 is representatively configured for holding a conventional plastic beer cup 56 of 20 fluid ounce capacity, commonly used at sporting events, festivals and the like. For this purpose, element 28 is conveniently L-shaped, having an elongate upstanding body 58 extending downwardly to one or more legs 60 angularly related to body 58. Cup 56 has a conventional tapered frustoconical outer surface, and a bottom of cup 56 will be supported on leg or legs 60 and the tapered side of cup 56 will be supported by body 58 at one or more locations. Element 28 can additionally include one or more support arms 62 projecting sidewardly for contacting the outer surface of cup 56 at one or more locations for providing lateral support. These elements of container holding element 28 can be suitably configured and sized for securely holding a wide variety of containers other than cup 56 shown, such as, but not limited to, cylindrical or barrel shaped cups, glasses, mugs, pitchers, and the like. Here, it should be noted that the configuration of container holding element 28 allows a cup 56 to be quickly and easily placed thereon and removed therefrom unobstructedly, so as to be suitable for high-volume environments, such as stadiums and the like. It should also be noted that the various aspects of container holding element 28 can be adjustable for receiving and holding different style containers, as desired.

Is contemplated that tilter 20 can be constructed of any of a variety of materials, such as, but not limited to, a metal, such as aluminum or steel, rigid plastics, and the like, and can be treated or coated so as to be corrosion resistant if desired.

Figure 3:
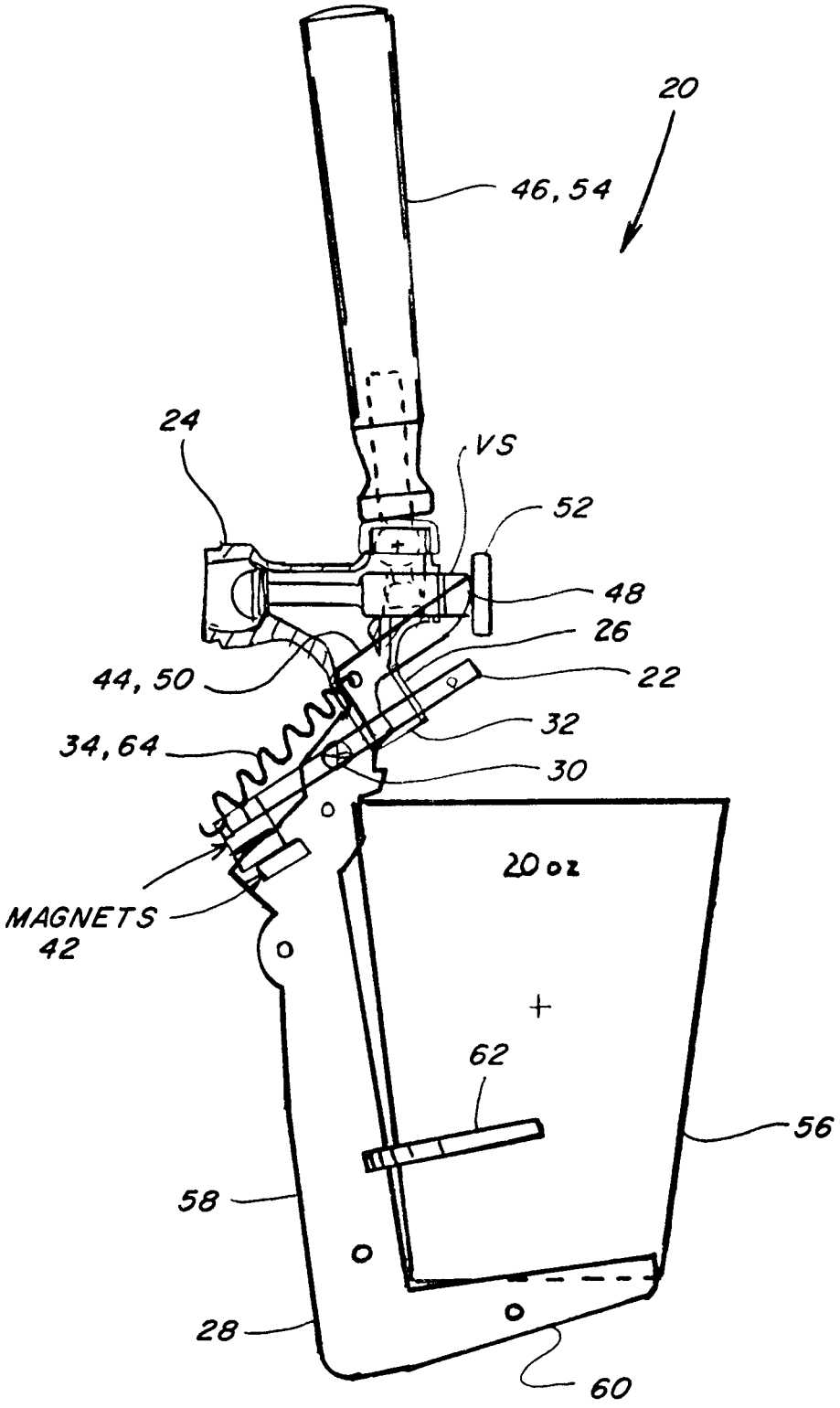
FIG. 3 is a side view of a beverage dispensing faucet including another embodiment of a tilter of the invention holding a container in an upright orientation under a spout of the faucet.
Figure 4:
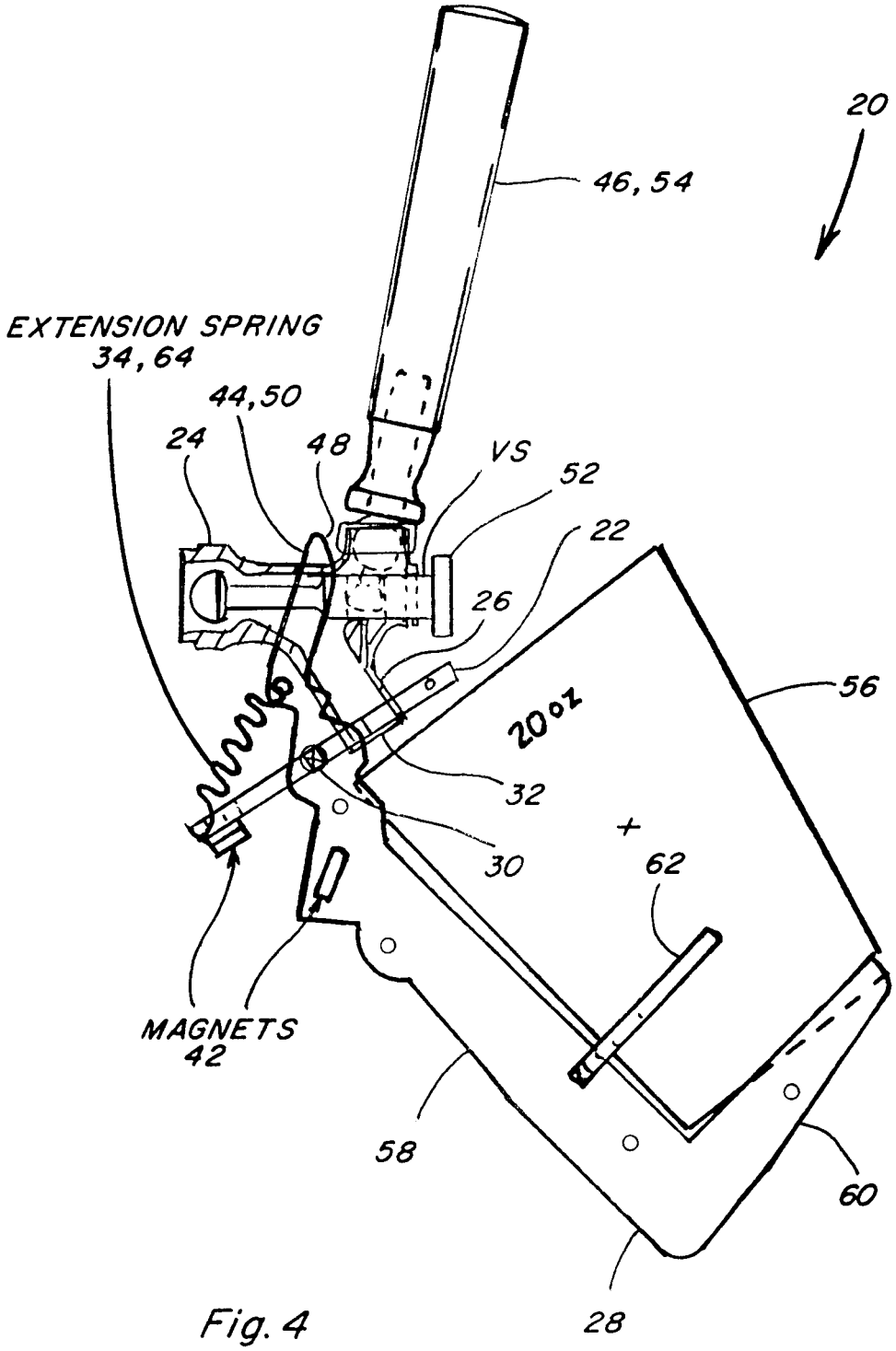
FIG. 4 is another side view of the faucet and tilter of FIG. 3, showing the tilter holding the container in a tilted position under the spout.
Figure 4A:
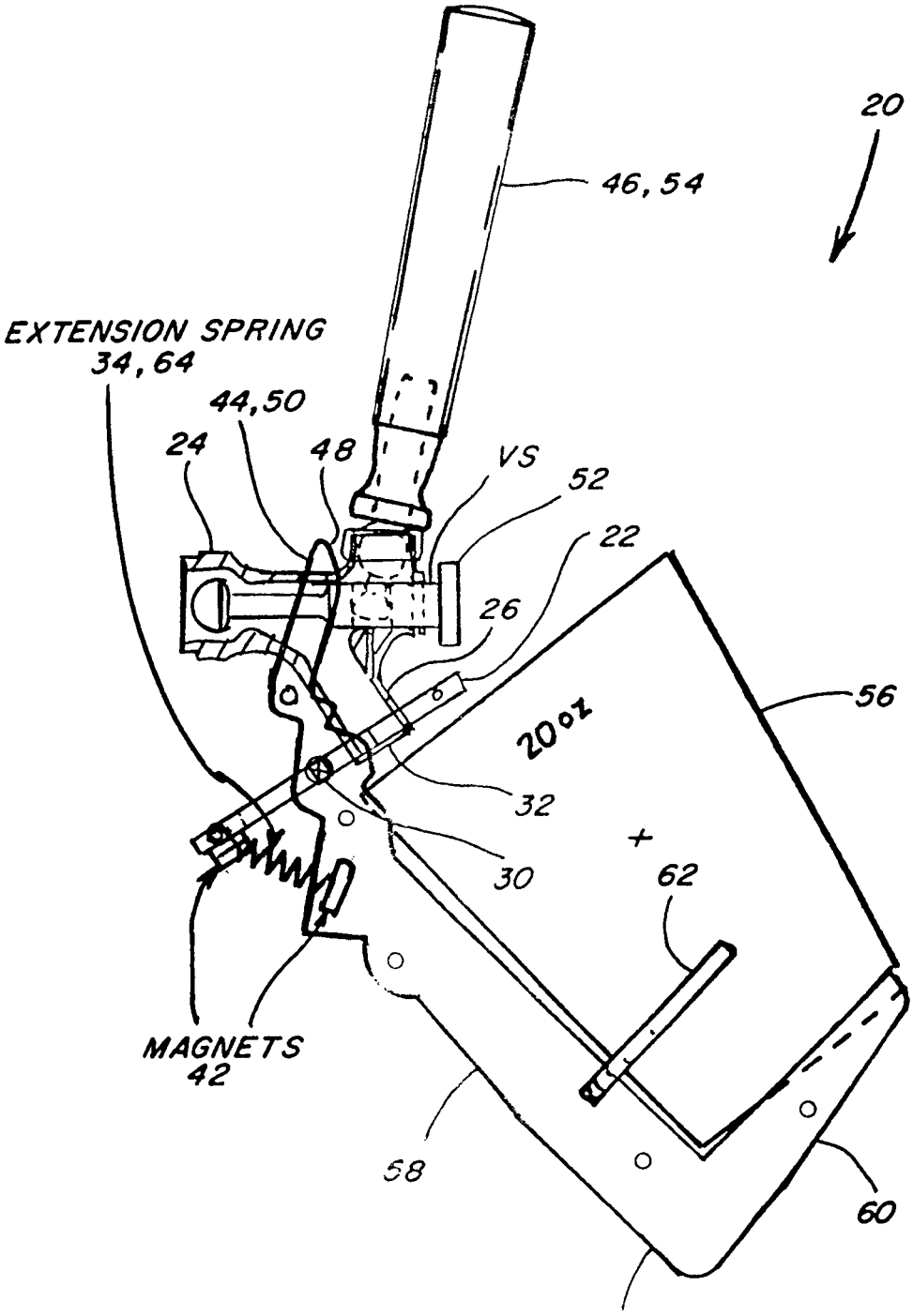
FIG. 4A is a side view of the faucet and tilter in a tilted to show an alternative location for a biasing element.

Referring also to FIGS. 3, 4, and 4A, tilter 20 is alternatively configured such that yieldable biasing element 34 comprises an extension spring 64 operable to urge container holding element 28 toward the position of FIGS. 4 and 4A. Alternatively, the tilter could be configured to utilize other types of springs, including, but not limited to, a compression spring, clock spring, or the like for this purpose. A detent element 42, again comprising attracting magnets, is operable to releasably detain container holding element in the position of FIG. 3. A lever arm 50 is again positioned in contact with a disk 52 in connection with valve stem VS to provide the triggering event or action for releasing spring 64 to release its stored energy to move element 28 to the initial highly tilted position of FIGS. 4 and 4A. Movement of element 28 back to the position of FIG. 3 will return spring 64 to the stored energy state. FIG. 4A illustrates tilter 20 with a spring in an alternative location adjacent to detent element 42. The triggering event or action is again contact of disk 52 with lever arm 50 to release detent element such that the spring will release its stored energy and expand as shown to move element 28 to the initial highly tilted position. Again also, movement of element 28 back to the position of FIG. 3 will return spring 64 to the stored energy state.

Figure 5:
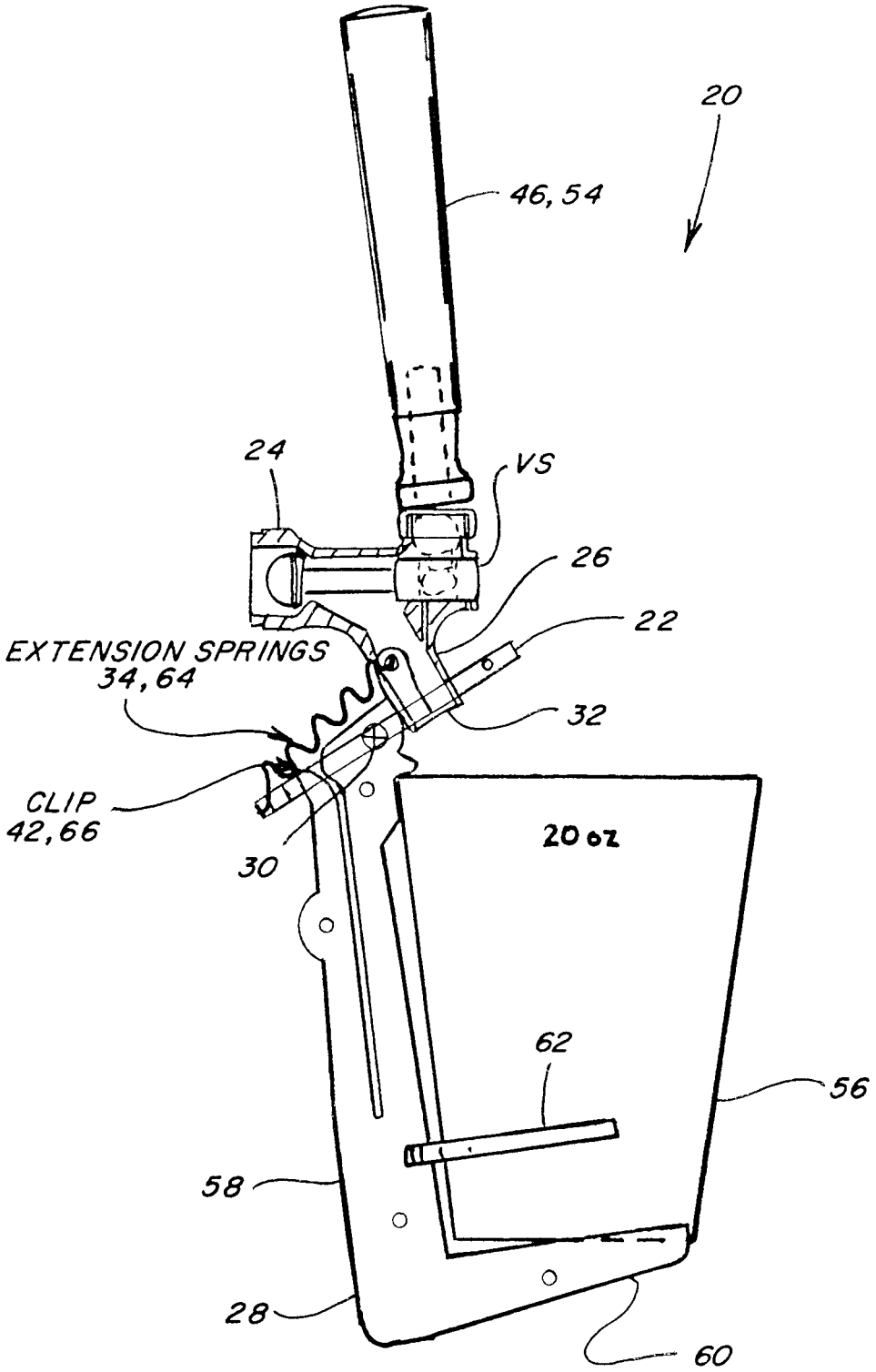
FIG. 5 is a side view of a beverage dispensing faucet including another embodiment of a tilter of the invention holding a container in an upright orientation under a spout of the faucet.
Figure 6:
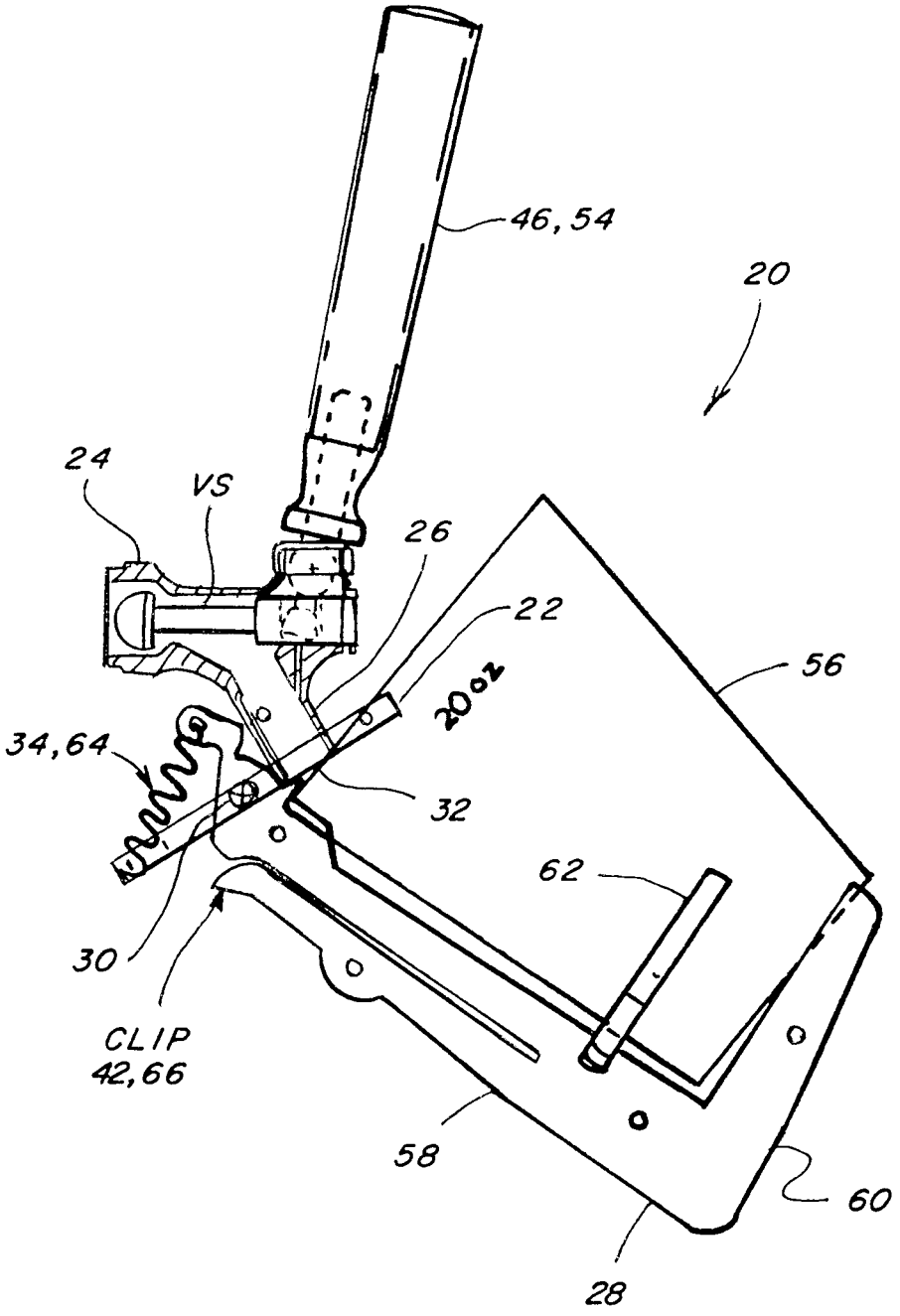
FIG. 6 is another side view of the faucet and tilter of FIG. 5, showing the tilter holding the container in a tilted position under the spout.

Referring also to FIGS. 5 and 6, tilter 20 is again configured such that biasing element 34 comprises a spring 64 urging container holding element 28 toward the position of FIG. 6, and detent element 42 comprises a clip 66 which engages an edge of mounting bracket 22 for releasably detaining container holding element 28 in the upright position (FIG. 5). Clip 66 can act in a manner similar to the magnets for releasing the energy of the spring. Here, tilter 20 is shown without lever arm 50 for initiating the tilting action, to illustrate that the tilting action of the tilter can be manually initiated by movement of element 28 from the detained position, but alternatively, the lever arm and disk arrangement can be provided. As another alternative, a release mechanism can be provided with the clip or magnets to initiate the tilting action.

Figure 7:
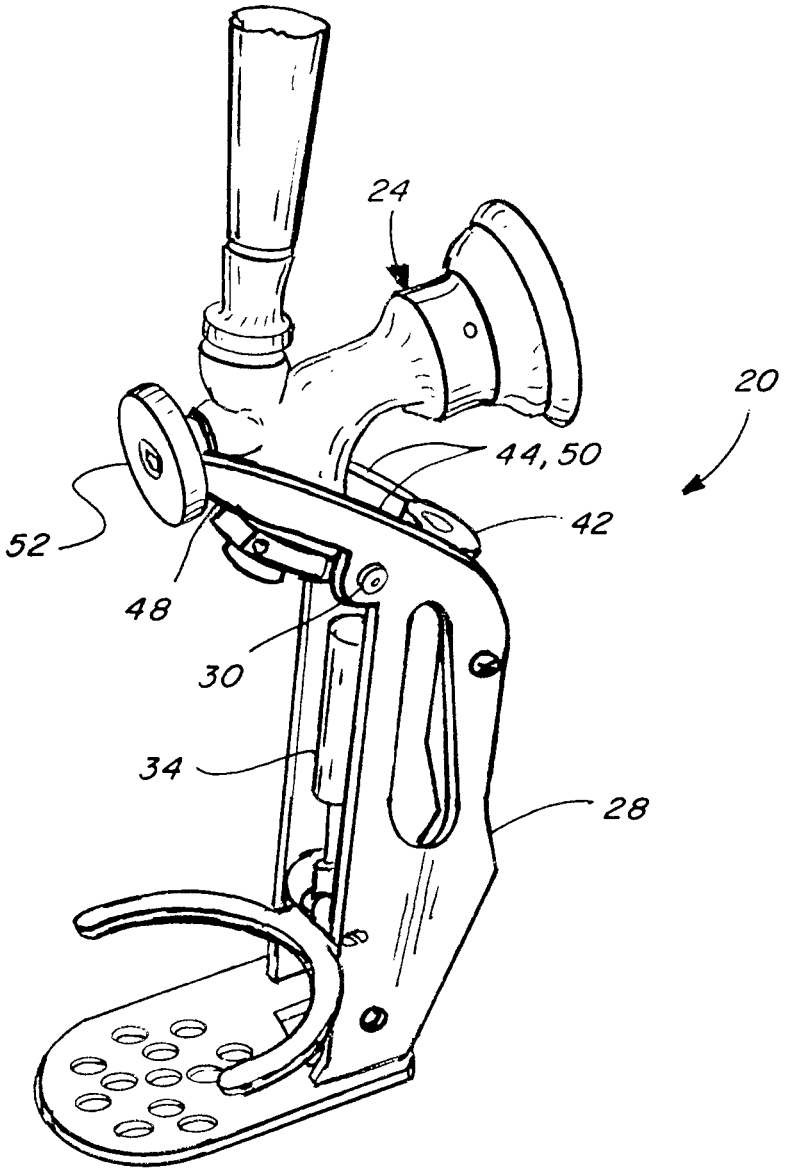
FIG. 7 is a perspective view of the faucet and tilter of FIG. 1.
Figure 8:
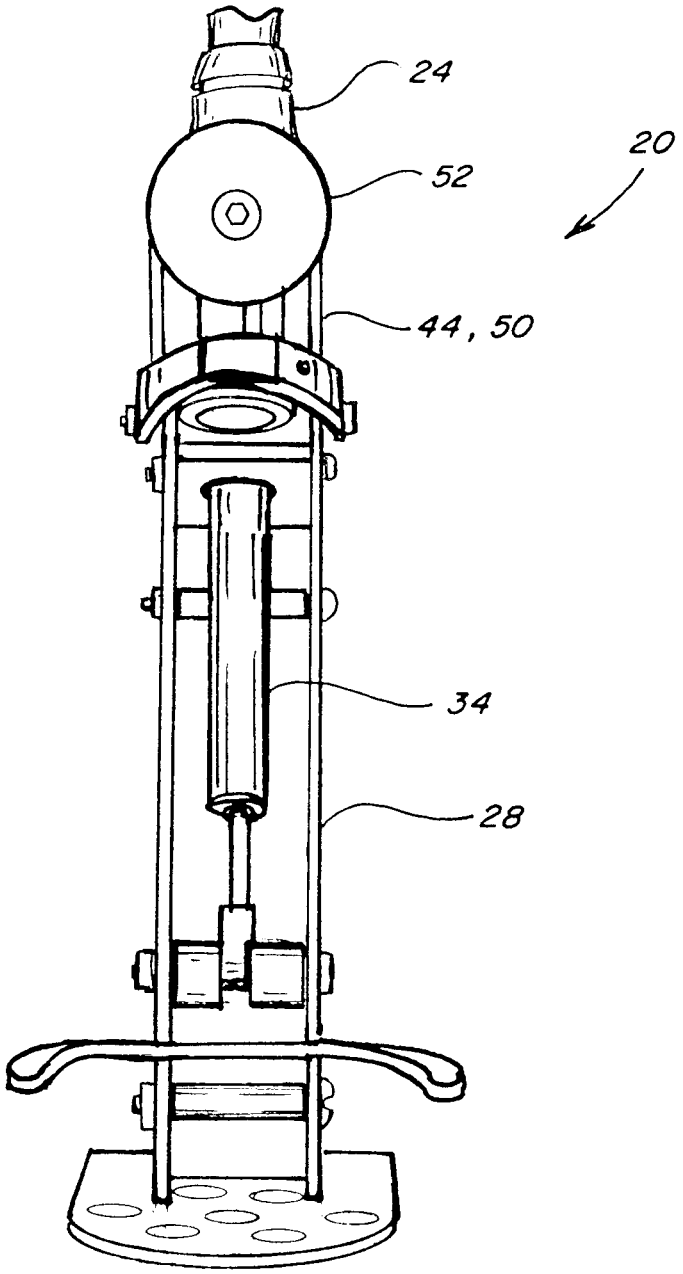
FIG. 8 is another perspective view of the faucet and tilter of FIG. 7.

Operation of the tilter 20 and faucet 24 will be described in reference to FIGS. 7 through 13. In FIGS. 7 and 8, tilter 20 is shown in a ready position with container holding element 28 empty and ready for receiving a container, in its upright position detained by detent element 42, and positioning lever arm 50 of apparatus 44 for releasing the detent element positioned adjacent to disk 52 of the faucet.

Figure 9:
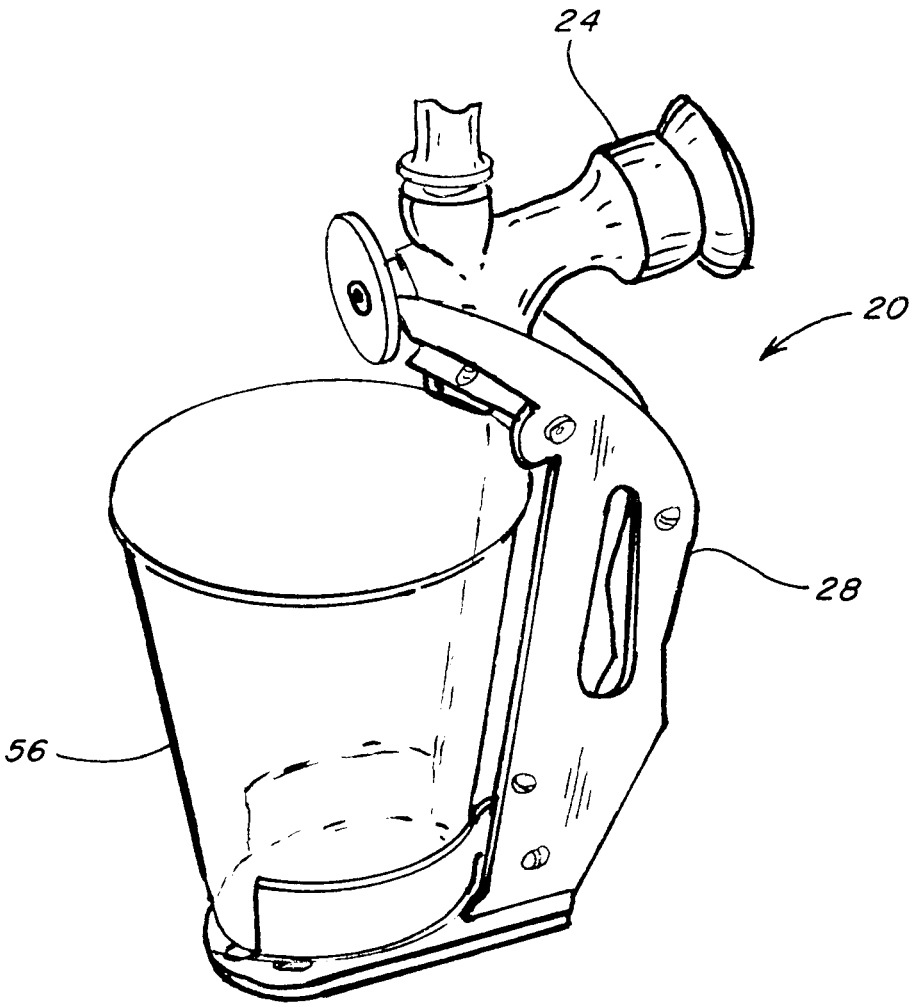
FIG. 9 is another perspective view of the faucet and tilter of FIG. 7, holding a container in an upright orientation ready for filling.

In FIG. 9, a cup 56 is placed on the container holding element 28 below the faucet 24 while detained in its upright position by the detent element. The container holding element 28 and cup 56 will remain detained in this position until released.

Figure 10:
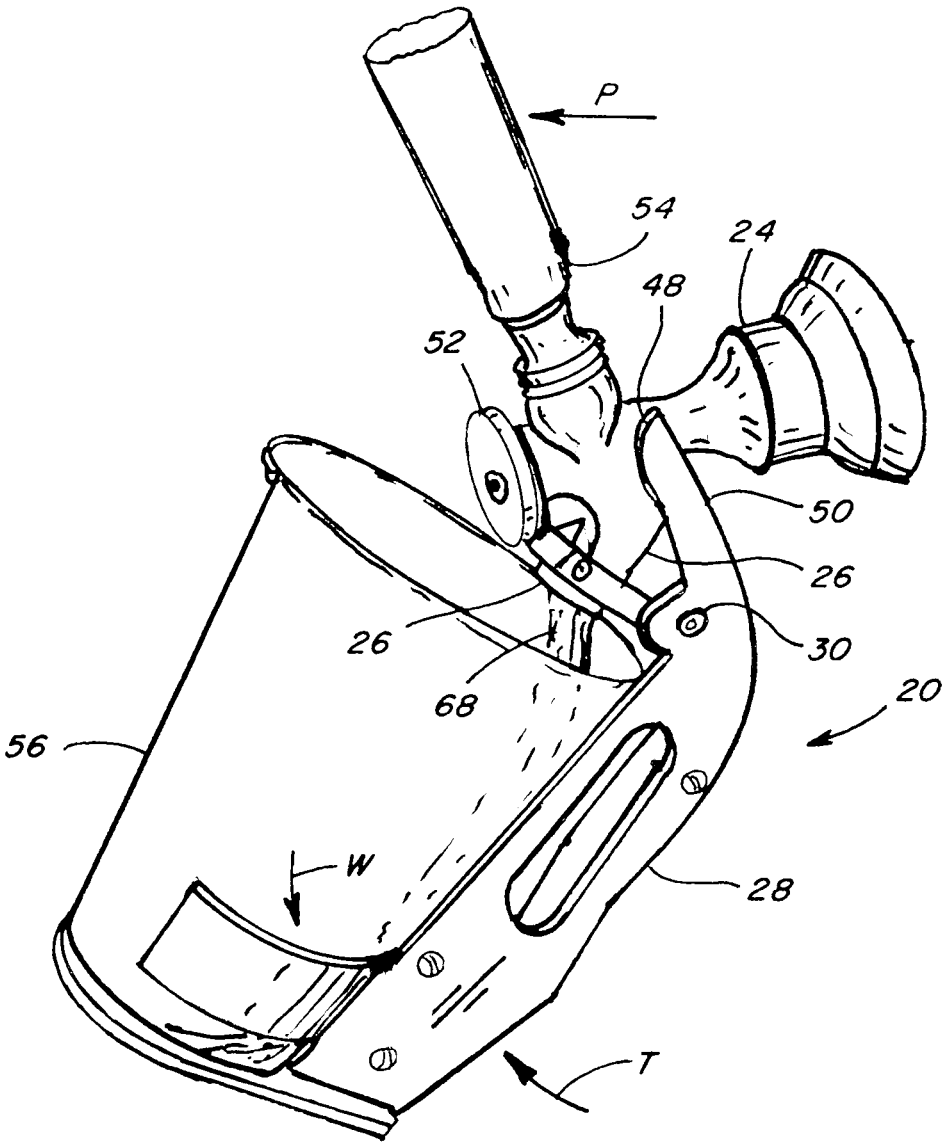
FIG. 10 is another perspective view of the faucet and tilter of FIG. 9 holding the container in a fully tilted orientation with the faucet open and dispensing a beverage into the container.

As illustrated in FIG. 10, when the dispensing lever 54 of the faucet 24 is pulled (denoted by arrow P) to commence the dispensing of beer 68 from spout 26, the holding force of the detent elements is overcome and the container holding element 28, with the cup 56 thereon, is automatically tilted about pivot joint 30 into the initial inclined position, as illustrated, by the above described triggering event of the striking contact of the disk 52 with contact surfaces of lever arms 50 to cause the release of the energy stored by the biasing element used, e.g., gas shock (also referred to as a gas a spring), spring, e.g., as illustrated by the extension of the gas shock in FIG. 2, and cup 56 is held in the tilted position by the biasing element, which exerts a force against container holding element 28 holding it and the cup in the tilted position as the beer is initially dispensed into the cup. In this position, contact surfaces 48 on lever arms 50 are no longer in contact with disk 52.

Figure 11:
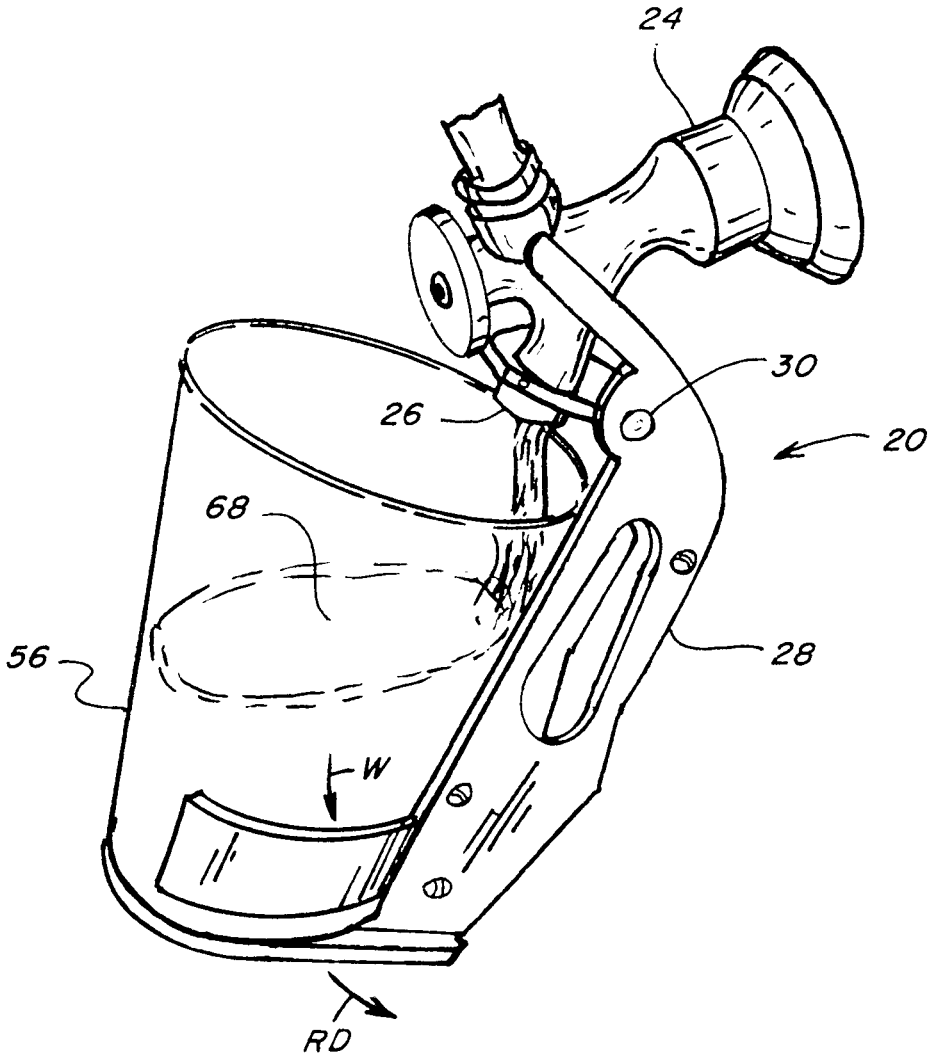
FIG. 11 is another perspective view of the faucet and tilter of FIG. 9 holding the container in a partially tilted orientation and partially filled, with the faucet open.

As illustrated in FIG. 11, as the amount of beer 68 in cup 56 dispensed from spout 26 increases, cup 56 will become heavier, and its weight W will counteract the force exerted by the biasing element 34 so as to act to cause that element to retract (thereby gradually returning the biasing element to the stored energy state) and pivot the container holding element 28 in the reverse direction about joint 30 as denoted by arrow RD, also gradually, toward the more upright position.

Figure 12:
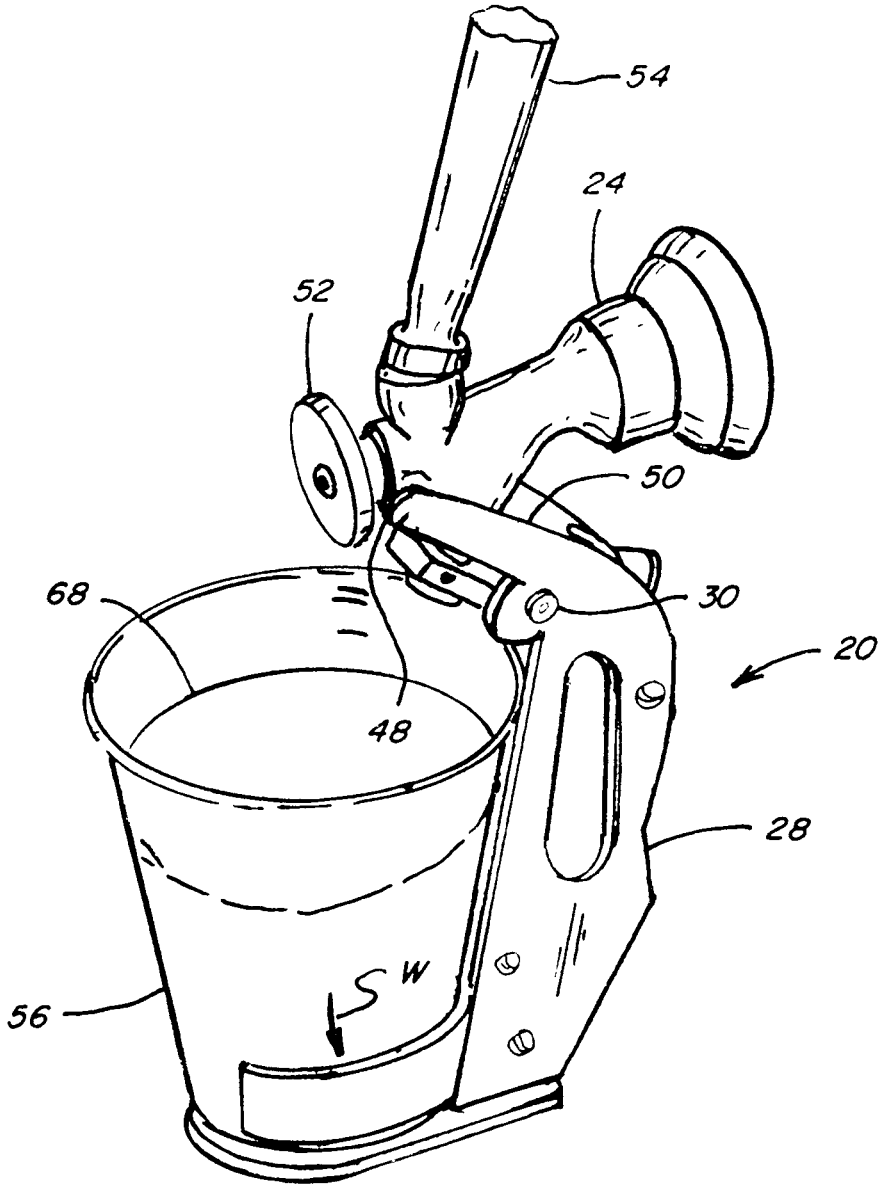
FIG. 12 is another perspective view of the faucet and tilter of FIG. 9 holding the container in the upright orientation after filling.
Figure 13:
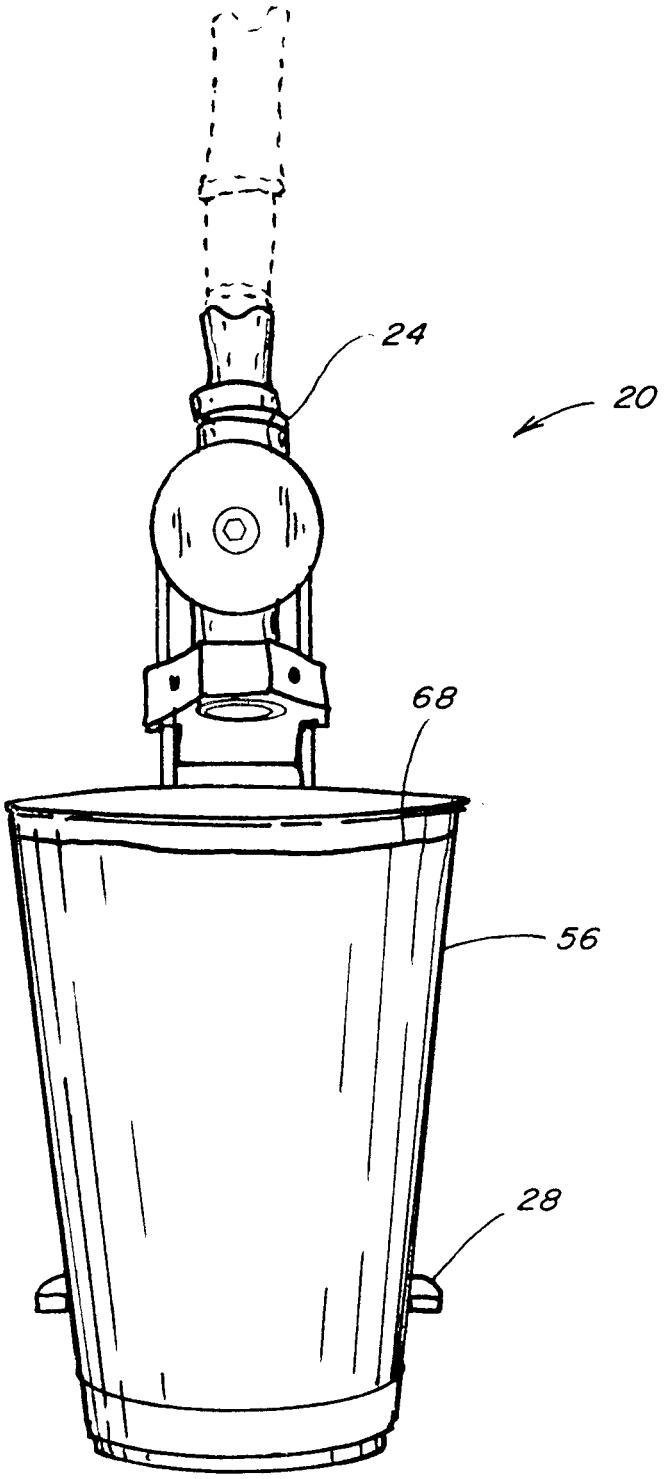
FIG. 13 is another perspective view of the faucet and tilter of FIG. 9 holding the container in the upright orientation after filling.

In FIGS. 12 and 13, element 28 is shown pivoted about joint 30, returned to the upright position. At this time, the contact surface 48 on the lever arm 50 will be brought into contact with the disk 52 on faucet 24 with sufficient force resulting from the weight W of the beer 68 in the now filled, or substantially filled, cup 56, to actuate the closing of the faucet 24, by pushing the disk 52 in the direction away from the faucet 24 and lever 54 is returned to its closed position. The detent elements are now engaged to hold the tilter in this position and the filled cup 56 is now in position to be removed. The biasing element 34 is also now recharged with energy.

As another feature of the invention, if a container is not adequately filled when returned to the upright position, or it is desired to add a head of foam to the beer, the dispensing lever can be momentarily operated one or more times to add beer to the cup, and because of the weight of the cup at least largely filled with beer, the weight will oppose release of the stored energy of the biasing element, and prevent significant tipping of the cup, and reduce possibility of spillage.

As still another feature of the invention, the biasing element 34 can be configured to damp the movement of element 28 from the upright position to the tilted position. In this regard, this capability can be incorporated into gas shock 36, or if a spring is used as element 34, in a damping system incorporating the spring.

Figure 14:
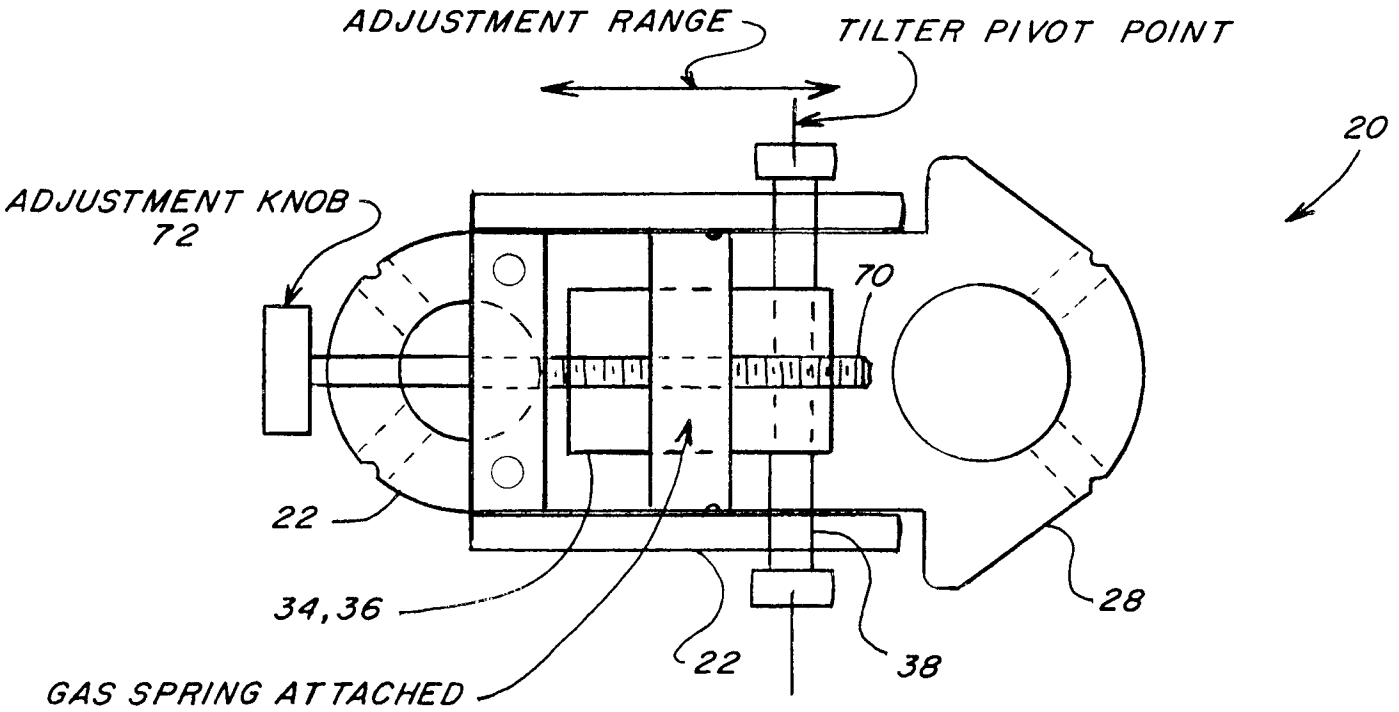
FIG. 14 is bottom view of the tilter of FIG. 1 showing an optional adjusting capability of the invention.

Referring also to FIG. 14, as an optional feature of the invention, biasing element 34 of tilter 20 can be configured to be adjustable, that is, to exert an adjustable force against container holding element 28, for use with containers of different empty weights and/or capacities. For instance, pivot joint 38 can be adjustably positioned along the mounting bracket to vary the orientation of gas shock 36 relative to the mounting bracket, to increase or decrease the force exerted by the gas shock 36 toward the position of FIG. 1. For ease of adjustment, pivot joint 38 and the upper end of container holding element 28 can be positioned and held in place by threaded placement on a threaded adjusting rod 70. Adjusting rod 70 is supported on mounting bracket 22 for rotation relative thereto and has a knob 72 that can be turned for rotating the rod. Adjusting rod 70 is threadedly received in and passes through a threaded passage through pivot joint 38, such that rotation of the rod will call the joint 38 to move longitudinally along the rod and also along mounting bracket 22.

Figure 15:
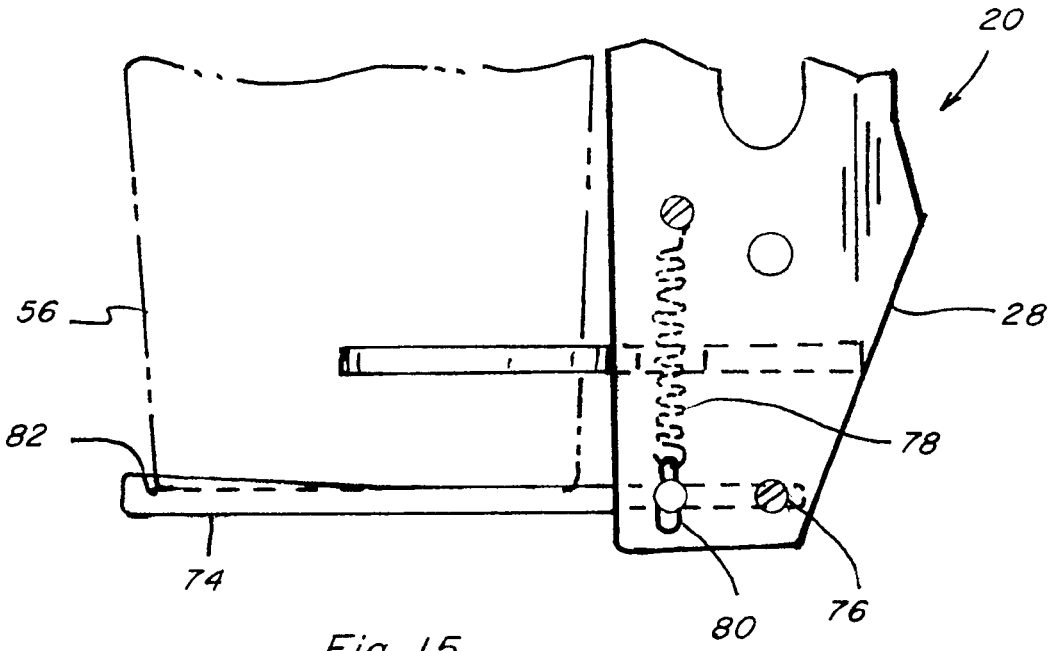
FIG. 15 is a fragmentary side view of the tilter showing a pivoting platform option for the container holding element.
Figure 16:
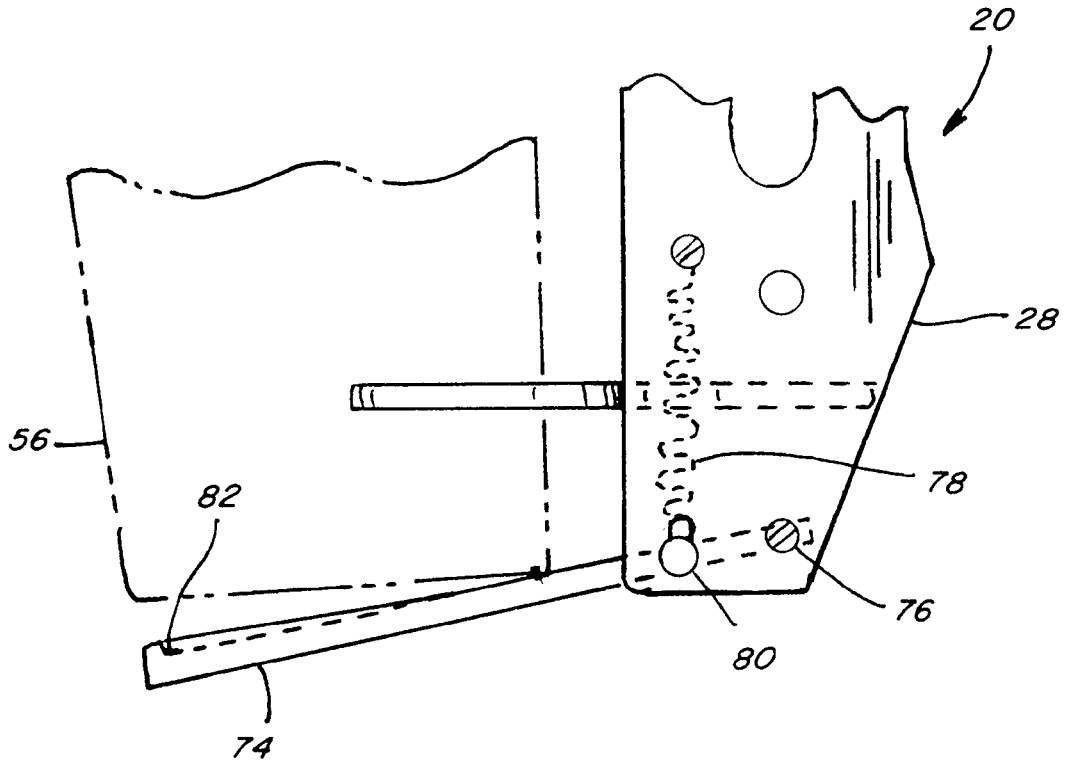
FIG. 16 is another fragmentary side view of the tilter, showing the platform pivoted.

Referring also to FIGS. 15 and 16, tilter 20 is illustrated including another optional feature which is a container holding element 28 including a pivoting platform 74 for supporting a container such as beer cup 56 illustrated. Platform 74 is attached to element 28 in a cantilever manner by a pivot joint 76 and is biased upwardly by a resiliently yieldable biasing element 78, here comprising a spring, limited by a detent element 80. Biasing element 78 is sufficiently strong to hold platform 74 in the orientation of FIG. 15 under the weight of a filled container only, but is resiliently biasable downwardly to the position shown in FIG. 16 by a user, to enable easily removing the container. Platform 74 can include a raised lip 82 on its outer periphery engageable with a container for holding it on the platform, as illustrated.

In light of all the foregoing, it should thus be apparent to those skilled in the art that there has been shown and described a tilter for holding a container in a particular position and orientation for receiving a beverage being dispensed from a dispensing system such as a beer faucet. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A tilter for holding a container for receiving a beverage dispensed from a beverage dispenser, the beverage dispenser having a spout from which the beverage is dispensed upon activation of a lever, comprising:

a beverage container holding element mounted to the beverage dispenser by a mounting bracket; and a biasing element coupled to the beverage container holding element and configured such that when a triggering event exerts a predetermined force thereagainst the biasing element will automatically pivot the container holding element from an upright position to a tilted position angularly related to the upright position for receiving the beverage dispensed from the spout into the container, and then as the container held by the container holding element is gradually filled with the dispensed beverage so as to gradually increase in weight, the gradual increase in weight causes the biasing element to automatically gradually yield to return the container holding element to the upright position; and wherein actuation of the lever simultaneously dispenses the beverage and causes the triggering event.

2. The tilter of claim 1, wherein the biasing element comprises a gas shock pivotally connected between the container holding element and the mounting bracket, and the triggering event comprises initially moving the container holding element away from the upright position.

3. The tilter of claim 2, further comprising a lever arm associated with the container holding element positioned, when the container holding element is in the upright position, to be contacted by an actuator element of the beverage dispenser when the dispensing of the beverage is initiated to initially move the container holding element away from the upright position.

4. The tilter of claim 1, wherein the biasing element is configured to store energy when the container holding element is in the upright position, and release the energy when the triggering event exerts the force thereagainst to move the container holding element to the tilted position.

5. The tilter of claim 1, wherein the beverage dispenser comprises a beer faucet.

6. The tilter of claim 1, further comprising detent elements configured to releasably hold the container holding element in the upright position.

7. The tilter of claim 6, wherein the detent elements comprise at least one magnet.

8. The tilter of claim 1, further comprising a lever arm coupled with the container holding element and positioned and configured to cooperate with the beverage dispenser to automatically close the beverage dispenser when the container holding element is returned to the upright position.

9. A tilter for holding a container for receiving a beverage dispensed from a spout of a beer faucet, comprising:

a mounting bracket configured to mount the tilter to a spout of a beer faucet;

a beverage container holding element supported by the mounting bracket for pivotal movement between an upright position below the spout and a tilted position below the spout angularly related to the upright position; and a biasing element connected between the mounting bracket and the beverage container holding element and configured to store energy when the container holding element is pivotally moved to the upright position and to automatically release the stored energy and move the container holding element to the tilted position upon exertion of a force thereagainst in a direction to initiate movement from the upright position toward the tilted position;

wherein actuation of the beer faucet initiates the movement of the container holding element from the upright position toward the tilted position.

10. The tilter of claim 9, wherein the biasing element is further configured to gradually move the container holding element from the tilted position to the upright position responsive to gradual filling of a container held by the container holding element with beer dispensed from the spout.

11. The tilter of claim 10, wherein the biasing element comprises a gas shock.

12. The tilter of claim 10 wherein the biasing element comprises a spring.

13. The tilter of claim 10 wherein the biasing element is adjustable.

14. The tilter of claim 9, wherein the container holding element is positioned and configured to automatically close the beer faucet when the container holding element reaches the upright position.

15. The tilter of claim 14, wherein the container holding element includes a lever arm positioned to engage and exert a force against the beer faucet to close the beer faucet when the container holding element reaches the upright position.

16. The tilter of claim 15 wherein the beer faucet includes a disk connected to a valve in the faucet, the disk being displaced by the lever arm to close the beer faucet when the container holding element reaches the upright position.

17. The tilter of claim 15, wherein the lever arm extends from the container holding element and is positioned so as to exert the force against the biasing element in the direction to initiate the movement from the upright position toward the tilted position.

18. The tilter of claim 9 wherein the container holding element includes a lever arm, wherein the beer faucet includes a disk connected to a valve in the beer faucet, and wherein the actuation of the beer faucet displaces the disk, the disk displacement causing the lever arm to exert the force against the biasing element in the direction to initiate the movement from the upright position toward the tilted position.

* * * * *